US006116171A

United States Patent [19]

Oota et al.

[11] Patent Number: 6,116,171

[45] Date of Patent: Sep. 12, 2000

[54] PULVERIZED COAL COMBUSTION BURNER

[75] Inventors: Hideaki Oota; Toshimitsu Ichinose; Masaharu Ooguri; Hitoji Yamada, all of Nagasaki, Japan

[73] Assignee: Mitsubishi Jukogyo Kabushiki Kaisha, Tokyo, Japan

[21] Appl. No.: 08/556,144

[22] Filed: Nov. 9, 1995

[30] Foreign Application Priority Data

| | | | |
|---|---|---|---|
| Nov. 14, 1994 | [JP] | Japan | 6-279102 |
| Apr. 18, 1995 | [JP] | Japan | 7-092302 |
| Jun. 13, 1995 | [JP] | Japan | 7-146067 |

[51] Int. Cl.[7] ..... F23D 1/00

[52] U.S. Cl. ..... 110/263; 110/265; 431/284

[58] Field of Search ..... 110/262, 263, 110/264, 265, 104 B, 347; 431/181, 182, 183

[56] References Cited

U.S. PATENT DOCUMENTS

| | | | |
|---|---|---|---|
| 2,320,575 | 6/1943 | Dunn | 431/185 |
| 5,090,339 | 2/1992 | Okiura et al. | 110/263 |

FOREIGN PATENT DOCUMENTS

| | | | |
|---|---|---|---|
| 0 056 709 | 7/1982 | European Pat. Off. . | |
| 0 343 767 | 11/1989 | European Pat. Off. . | |
| 0 554 014 | 8/1993 | European Pat. Off. . | |
| 0 571 704 | 12/1993 | European Pat. Off. . | |
| 6-80364 | 10/1994 | Japan | 110/263 |

*Primary Examiner*—Henry A. Bennett
*Assistant Examiner*—Pamela O'Connor
*Attorney, Agent, or Firm*—Wenderoth, Lind & Ponack

[57] ABSTRACT

A pulverized coal combustion burner has a circumferential distribution of pulverized coal density at an outlet portion of a pulverized coal nozzle made uniform, and a complete $NO_x$ decrease is attained. An oil gun (01) for stabilizing combustion is provided at a center portion. An annular sectional oil primary air flow path (02) surrounds the oil gun (01), and an annular sectional pulverized coal and primary air mixture flow path (14) surrounds the oil primary air flow path (02). Around the mixture flow path (14) is an annular sectional secondary air flow path (15), and an annular sectional tertiary air flow path (16) surrounds the secondary air flow path (15). A pulverized coal supply pipe is connected in the tangential direction to the mixture flow path (14). Further, an entering angle control (28) of the mixture is provided within the pulverized coal supply pipe (11). Within the mixture flow path (14), a pulverized coal density dividing cylinder (25) is provided.

22 Claims, 15 Drawing Sheets

PULVERIZED COAL COMBUSTION BURNER

BACKGROUND OF THE INVENTION

1. Field of the Invention

The present invention relates to a pulverized coal combustion burner to be applied to a pulverized coal firing boiler, a chemical industrial furnace, etc. for public power utilities and other industries.

2. Description of the Prior Art

FIG. 11 is a longitudinal sectional view showing an example of a cylinder type pulverized coal burner in the prior art which is a basis of the present invention. FIG. 12 is a front view of the same, and FIG. 13 is a transverse sectional view taken on line VIII—VIII of FIG. 11. In this burner, there is provided an oil gun (01) for stabilizing combustion at the axial center portion of the burner, and an oil primary air flow path (13) surrounding the oil gun (01) partitioned at its outer circumference by an oil primary air pipe (02). A pulverized coal and primary air mixture flow path (14) is on the outer side of the oil primary air flow path (13) partitioned at its outer circumference by a primary air pipe (03). A secondary air flow path (15) is further on the outer side of the pulverized coal and primary air mixture flow path (14), partitioned at its outer circumference by a secondary air pipe (04), and a tertiary air flow path (16), further, is on the outer side of the secondary air pipe (04), partitioned at its outer circumference by an outer cylinder.

At a terminal end portion of the oil primary air flow path (13), a swirl vane (05) is provided for maintaining stable flames of heavy oil. The oil primary air is supplied at a ratio of 5% to 10% of the entire air amount as auxiliary air at the time of heavy oil firing or combustion stabilizing.

Secondary air and tertiary air for main combustion are divided into the secondary air and the tertiary air by an air wind box (09). The secondary air is given the necessary swirl forces by a secondary swirl vane (07) and is supplied into a furnace through the secondary air flow path (15) and a secondary air nozzle (18). Likewise, the tertiary air also is given necessary swirl forces by a tertiary air swirl vane (08) and is supplied into the furnace through the tertiary air flow path (16) and a tertiary air nozzle (19).

On the other hand, as shown in FIG. 13, pulverized coal as a main fuel is supplied into the burner together with the primary air for carrying via a pulverized coal supply pipe (11) connected perpendicularly to the primary air pipe (03), and is carried further into the furnace through the mixture flow path (14) and a pulverized coal nozzle (17). The pulverized coal jetted from the pulverized coal nozzle (17) is ignited and burns as it diffuses and mixes with the secondary air and the tertiary air. Complete combustion takes place with the air from an after-air port (not shown) provided downstream of the furnace.

Incidentally, at a terminal end portion of the secondary air nozzle (18) which corresponds to the outer circumference of the primary air and pulverized coal mixture flow path (14), there is provided a flame stabilizing plate (06).

In the axially symmetrical cylinder type burner in the prior art, there is the following shortcoming.

As pulverized coal supplied into the burner flows in perpendicularly to the axis of the primary air pipe (03), bias flows occur in the pulverized coal and primary air mixture flow path (14), and the pulverized coal density distribution in the circumferential direction at the outlet portion of the pulverized coal nozzle (17) becomes extremely non-uniform. Accompanying this, the distance between the burner and the point of ignition of the pulverized coal becomes non-uniform in the circumferential direction. That is, in the area where the pulverized coal density is high, the ignition point is near, and in the area where it is low, the ignition point becomes far. If the ignition point becomes non-uniform, there is a fear of the burner being damaged by heat in the area where the ignition point is near. Further, in the area where the ignition point is far, as the secondary air has already partially diffused, the air ratio at the ignition point becomes high and an oxidation flame is generated. Thus an increased amount of $NO_x$ is generated.

Following is a description of a burner in the prior art shown in FIG. 14 and FIG. 15.

FIG. 14 is a longitudinal sectional view showing an example of a coal firing cylinder type burner in the prior art, and FIG. 15 is a transverse sectional view taken on line V—V of FIG. 14. In these figures, each numeral designates a respective component and part as follows: (201) a burner wind box, (202) a pulverized coal and primary air mixture cylinder, (203) a flame stabilizing plate, (204) a secondary air cylinder, (205) a tertiary air cylinder, (206) an oil burner gun guide pipe, (207) an oil burner gun, (208) a pulverized coal dense/thin separator, (209) a secondary air amount adjusting damper, (210) a secondary air swirl vane, (211) a tertiary air swirl vane, (212) a pulverized coal mixture throwing pipe, (213) a burner front wall, (214) a pulverized coal mixture compartment, (215) a secondary air compartment, (216) a tertiary air compartment, (217) a secondary air amount adjusting damper operation lever, (218) a secondary air swirl vane operation lever, (219) a tertiary air swirl vane operation lever, (220) seal air, (221) pulverized coal mixture, (222) secondary air, (223) tertiary air, (224) liquid fuel and (225) a boiler furnace.

Combustion air supplied from air blowing equipment (not shown) is divided, while it is flowing, into the secondary air (222) and the tertiary air (223) within the burner wind box (201).

The secondary air (222) is adjusted to the necessary amount by the-secondary air amount adjusting damper (209) operated by an operation lever (217) and is supplied into the secondary air compartment (215) within the secondary air cylinder (204) via the secondary air swirl vane (210) operated by an operation lever (218) and then is blown into the boiler furnace (225). The remaining combustion air is supplied as the tertiary air (223) into the tertiary air compartment (216) within the tertiary air cylinder (205) via the tertiary air swirl vane (211) and then is blown into the boiler furnace (225).

Coal as a fuel is pulverized by coal pulverization equipment (not shown), is mixed with the primary air and is supplied as the pulverized coal mixture (221) to be blown into the pulverized coal mixture compartment (214) within the pulverized coal mixture cylinder (202) from the pulverized coal mixture throwing pipe (212). At the terminal end of the pulverized coal mixture cylinder (202), the flame stabilizing plate (203) is provided and, inside thereof, the oil burner gun guide pipe (206) passing through the pulverized coal mixture cylinder (202) is provided. On the outer circumference of the oil burner gun guide pipe (206), the cylindrical pulverized coal dense/thin separator (208), the front part and the rear part of which are reduced, is provided so as to be positioned near the outlet of the pulverized coal mixture compartment (214).

Within the oil burner gun guide pipe (206), there is provided the oil burner gun (207) for atomized combustion of the liquid fuel (224). Combustion of the liquid fuel (224) by the oil burner gun (207) is made for the purpose of raising the temperature within the boiler furnace (225) before pulverized coal combustion is commenced. Within the oil burner gun guide pipe (206), the seal air (220) is continuously supplied from air blowing equipment (not shown) so that the oil burner gun guide pipe (206) may not be blocked by the pulverized coal after the pulverized coal combustion is commenced.

The pulverized coal mixture (221) blown into the pulverized coal mixture compartment (214) is accelerated while it passes around the outer circumference of the pulverized coal dense/thin separator (208), and at the outlet portion of the pulverized coal mixture compartment (214) it suddenly expands and is decelerated. At this time, the pulverized coal within the pulverized coal mixture (221) flows, for the most part, biassed by the inertia force to the outer circumferential side, or along the inner wall surface side of the pulverized coal mixture cylinder (202). On the center portion side of the outlet of the pulverized coal mixture compartment (214), there flows the primary air within the pulverized coal mixture (221) and a small amount of the pulverized coal of fine particles mixed therewith. Accordingly, the jet flow of the pulverized coal mixture (221) blown into the boiler furnace (225) has a density distribution wherein the pulverized coal density is high on the surface (outer side) and is low on the inner side.

The flame stabilizing plate (203) provided at the terminal end of the pulverized coal mixture cylinder (202) generates swirl flows of the secondary air (222) flowing on the outer circumference of the pulverized coal mixture cylinder (202) on the back side surface of the flame stabilizing plate (203). Thus the pulverized coal on the surface (outer side) of the jet flow of the pulverized coal mixture (221) is taken therein and ignited, and the pulverized coal flame at the ignition portion is stabilized.

The pulverized coal mixture (221) blown into the boiler furnace (225) from the pulverized coal mixture cylinder (202) is ignited by an ignition source (not shown), while at around the jet portion the pulverized coal mixture (221) is ignited on the surface side of the jet flow of the pulverized coal mixture (221). As it proceeds downstream of the jet flow of the pulverized coal mixture (221), ignition proceeds in the direction of the inner side, and thus pulverized coal flames are generated. FIG. 16 is a schematic drawing showing a model of a pulverized coal flame. The nearer the ignition point is to the jet portion of the pulverized coal mixture (221), the more the pulverized coal flame tends to stabilize. At the ignition point of the pulverized coal flame, as shown in FIG. 16, the surface of the jet flow of the pulverized coal mixture (221) is heated by an ignition source. Thereby a volatile content is generated and ignited. Accordingly, if the pulverized coal density on the surface side of the jet flow is high near the jet portion of the pulverized coal mixture (221), the ignition point of the pulverized coal flame comes nearer to the jet portion, and stable pulverized coal flames are generated. The pulverized coal flames so generated continue combustion by the secondary air (222) and the tertiary air (223) blown from the circumference thereof.

In the above described coal firing cylinder type burner in the prior art shown in FIG. 14 and FIG. 15, there are shortcomings to be solved as follows.

While the pulverized coal density distribution adjustment of the jet flow of the pulverized coal mixture (221) at the outlet of the pulverized coal mixture compartment (214) is made by the pulverized coal dense/thin separator (208), the pulverized coal density on the surface side of the jet flow does not become high enough. Thus in a combustion of low volatile content coals in which the fuel ratio (ratio of solid carbon content and volatile content) is high, the ignition point of the pulverized coal flame is moved far from the outlet of the pulverized coal mixture compartment (214). Thus the ignition stability of the flame is not good enough.

Further, if the combustion amount within the boiler furnace (225) is decreased, the pulverized coal density of the pulverized coal mixture (221) supplied from coal pulverizing equipment becomes lower and the ignition stability of the pulverized coal flame in low load combustion becomes worse.

Following is a description of a burner in the prior art shown in FIG. 17.

FIG. 17 is a schematic longitudinal sectional view of a main part of a pulverized coal burner in the prior art. An outer circumferential cylinder (307) is on the inner side of a furnace wall port (309) via a tertiary air jet port (308). A burner body (3011) is at the center on the inner side of the outer circumferential cylinder (307) via a secondary air jet port (306). Pulverized coal and primary air are supplied from the burner body (3011).

A duct damper (not shown) is provided at an inlet on the left side of the figure, and the air amount is increased or decreased unitarily, not by each of the primary to the tertiary flow paths.

The right side of FIG. 17 is a conceptual drawing of combustion, which shows that the combustion proceeds downstream with two stages. A reduction atmosphere stage has the air ratio less than 1, and an oxidation atmosphere stage has the air ratio more than 1. That is, the pulverized coal first has volatile content combustion in the reduction atmosphere and generates $NO_x$, and then has combustion to convert to $N_2$. or an oxidation combustion.

Recently, as is known, since low $NO_x$ is required for every kind of exhaust gasses, in the above-mentioned combustion also, in order to immediately convert the $NO_x$ generated in the reduction atmosphere to $N_2$ air (oxygen in fact) could be supplied quickly within the range where the temperature does not decrease. But, there is a problem in that if, for example, the primary air amount supplied is too much of the ratio of cooling heat to combustion heat becomes too high so that the volatile content combustion does not develop. And even if the primary air amount is appropriately suppressed and the secondary and tertiary air are increased, due to the air flow line made by the terminal end (the right end of the figure) of the burner body (301') and the outer circumferential cylinder (307) being open like a funnel, as shown in figure, the air is not able to mix well into the combustion area unless it comes comparatively downstream. Needless to mention, the funnel-like opening at the terminal end of the burner body (301') and the outer circumferential cylinder (307) is indispensable for air to be uniformly mixed into so-called combustion flames of a generation gas ($NO_x$ etc.), air, etc. within the combustion area, which makes a sudden expansion by combustion, and that the current velocity of frames is appropriately suppressed so as to secure enough heat transmission to be the furnace wall pipes, etc.

The $NO_x$ generation amount in relation to the reduction atmosphere temperature taken at the portion when the pulverized coal finishes combustion after the reduction atmosphere and the oxidation or on the extreme right side of FIG. 17, is shown in FIG. 18. This figure shows that the higher the reduction atmosphere temperature, the lesser the $NO_x$ amount.

FIG. 19 is a diagram showing the relation between the secondary air amount and the coal volatile amount in the example shown in FIG. 18.

In the above-described pulverized coal combustion burner in the prior art shown in FIG. 17, there are such shortcomings to be solved as follows.

In this pulverized coal combustion burner in the prior art, the jet ports of the primary air carrying the pulverized coal and of the secondary and tertiary air are fixed, and the air amount cannot be adjusted to the kind of coal at the jet ports. Accordingly, the adjustment of the air amount is made by the usual duct damper provided at the inlet being adjusted.

A low $NO_x$ combustion by the pulverized coal combustion burner depends on how quickly the coal volatile content combustion is made at the reduction are immediately after the jet ports, and how quickly the generated $NO_x$ is converted to $N_2$ while the temperature does not decrease downstream. But, as the volatile content varies according to the kind of coal, and many kinds of coal are used in a power station, there is a problem in that pulverized coal combustion burner in the prior art has funnel-like openings fixed so that the mixing area of the secondary air comes downstream and a low $NO_x$ combustion is not well attuned to the kind of coal.

SUMMARY OF THE INVENTION

It is therefore an object of the present invention to provide a pulverized coal combustion burner which is able to make a circumferential distribution of a pulverized coal density uniform at the outlet portion of a pulverized coal nozzle as well as to secure the generation of a dense mixture at the outer circumference and a thin mixture on the inner side and to form pulverized coal flames which have stable ignition points.

It is a further an object of the present invention to provide a pulverized coal combustion burner which is able to decrease the $NO_x$ amount in the combustion process.

In order to attain these objects, the present invention provides a pulverized coal combustion burner comprising an oil gun for stabilizing combustion at the center portion, an annular sectional oil primary air flow path surrounding the oil gun, an annular sectional pulverized coal and primary air mixture flow path surrounding the oil primary air flow path, an annular sectional secondary air flow path surrounding the mixture flow path and an annular sectional tertiary air flow path surrounding the secondary air flow path. A pulverized coal supply pipe is connected in the tangential direction to the mixture flow path.

The pulverized coal combustion burner according to the present invention is constructed as mentioned above and the pulverized coal supply pipe is connected in the tangential direction to the pulverized coal mixture flow path. The pulverized coal mixture is thereby given swirling forces and the pulverized coal density becomes high at the outer circumferential portion of the mixture flow path and thin on the inner side. By this swirling, the circumferential density distribution becomes uniform.

In addition to the construction of the pulverized coal combustion burner according to the present invention, if a throwing velocity adjustment plate of the pulverized coal mixture is provided within a pulverized coal mixture throwing pipe, a blowing velocity of the pulverized coal can always be appropriately maintained, even in a low load operation.

Further, in addition to the throwing velocity adjustment plate, if a construction is such that the front portion of the inside of the pulverized coal mixture cylinder is divided into an outer portion and an inner portion and a pulverized coal density separation cylinder which forms an annular sectional dense mixture path on the outer side and a thin mixture path on the inner side is provided, then the dense mixture and the thin mixture, respectively, flow into the annular sectional dense mixture path formed on the outer side and the thin mixture path formed on the inner side of the pulverized coal density separation cylinder. Thus a pulverized coal combustion burner which can securely form a dense and thin mixture is obtained.

Or, in addition the construction of a pulverized coal combustion burner according to the present invention, as mentioned above, in which a pulverized coal supply pipe is connected in the tangential direction to the mixture flow path, if a construction is such that a means to control the entering angle of the pulverized coal mixture is provided at the terminal end of the pulverized coal supply pipe, the swirling force of the pulverized coal mixture can be controlled. Accordingly, even if a combustion load decreases and the pulverized coal density in the mixture becomes lower, the pulverized coal is concentrated in the outer flow path. The pulverized coal density in that flow path is maintained at a certain level and the ignition can be stabilized.

Further, in a pulverized coal combustion burner according to the present invention in which a pulverized coal supply pipe is connected in the tangential direction to the mixture flow path, as mentioned above, if the mixture flow path is constructed so as to comprise an inner cylinder element having a flange which opens at the terminal end portion in a funnel shape and is intermittently cut-off, portions along the circumference and an outer cylinder element surrounding the inner cylinder element, having a flange of the same shape as that of the inner cylinder element at the terminal end portion and being rotatable around the axis relatively to the inner cylinder element, an $NO_x$ decrease can be efficiently attained.

That is, by use of a construction in which the oil gun for stabilizing combustion and the oil primary air flow path are surrounded by the inner cylinder element and the outer cylinder element of the construction, when the oil gun is ignited, pulverized coal combustion is commenced upon the pulverized coal and the pulverized coal carrying air being jetted from the outer circumference and a sufficient reduction atmosphere and oxidation atmosphere are generated. If the outer cylinder element, for example, is rotated relative to the inner cylinder element, then the cut-off portions of each flange (hereinafter the flange with the cut-off portions are referred to as "flange") are lapped (open), or rotatively separated (closed), with respect to each other in the circumferential direction. In the case of lapping, the outer circumferential secondary air comes straight into the flange area through the orb cut off portions made and so that a quick secondary air supply is a low $NO_x$ area (conversion to $N_2$) is made efficiently. In the case of the rotative separation of the flanges, the cut-off portion proceed in a direction to close each other, the straight flow of the secondary air decreases and stops upon closing, and funnel-like flange without cut-off portions, equivalent to a conventional one, is formed.

If the opening of the cut-off portions of each controlled appropriately, a straight flow of air which is best suited to the kind of coal can be obtained.

Incidentally, the outer cylinder generates secondary and tertiary air, similarly to the conventional outer cylinder.

DESCRIPTION OF THE PREFERRED EMBODIMENTS

Following is a description in a concrete form of a pulverized coal combustion burner according to the present invention based on preferred embodiments shown in FIG. 1 to FIG. 10.

(First Preferred Embodiment)

Figure 11:
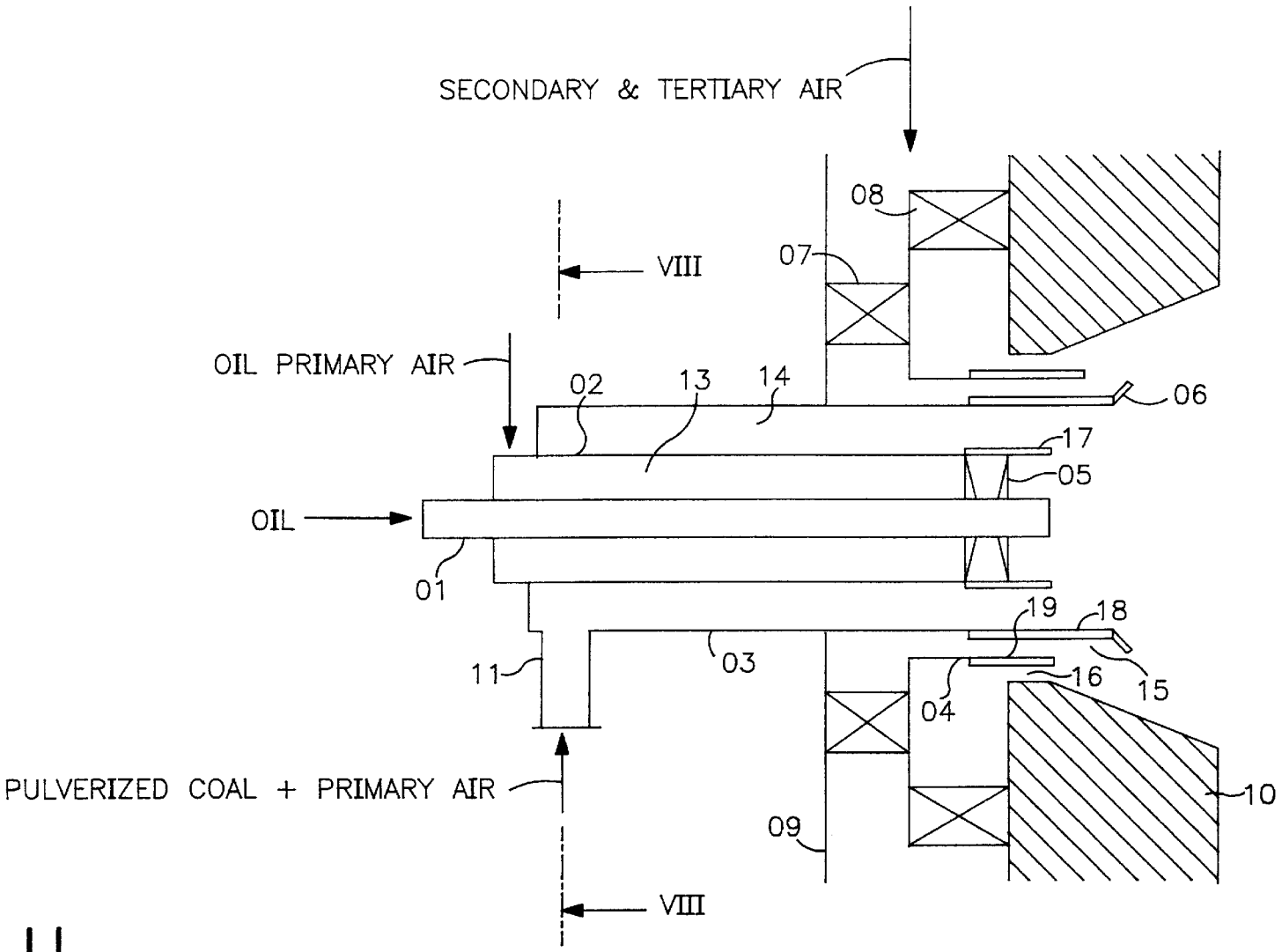
FIG. 11 is a longitudinal sectional view showing an example of a pulverized coal burner in the prior art.
Figure 12:
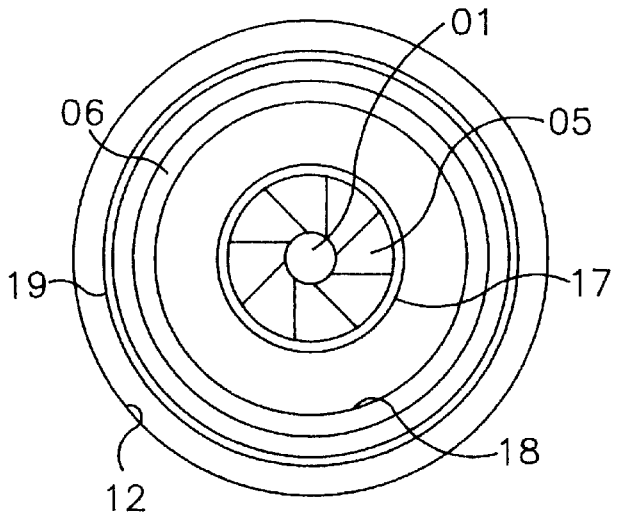
FIG. 12 PRIOR ART
FIG. 12 is a front view of FIG. 11.
Figure 13:
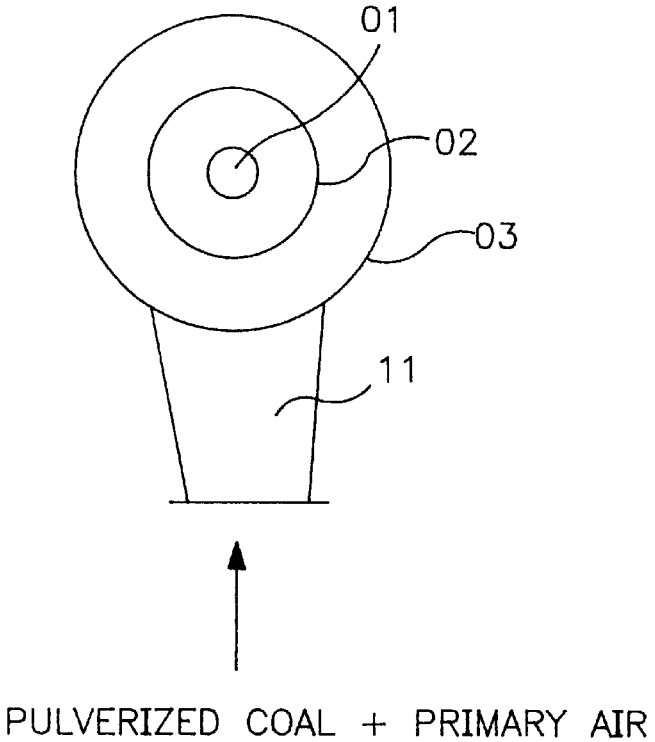
FIG. 13 PRIOR ART
FIG. 13 is a transverse sectional view taken on line VIII—VIII, of FIG. 11.

A first preferred embodiment shown in FIG. 1 to FIG. 5 is described. In FIG. 1 to FIG. 5, same or similar components or parts as those of the prior art described in FIG. 11 to FIG. 13 is given the same numeral to avoid redundancy, and their detailed description is omitted.

In this first preferred embodiment, a pulverized coal supply pipe (11) is connected to a mixture flow path (14) in the tangential direction with a certain entering angle $\alpha$, (45°–90°). At the terminal end of the pulverized coal supply pipe (11) a block (28) is provided to be pivotal to the right and left on the burner transverse section around an axis on the inner end face of the pulverized coal supply pipe (11) for controlling the entering angle of the mixture.

Figure 1:
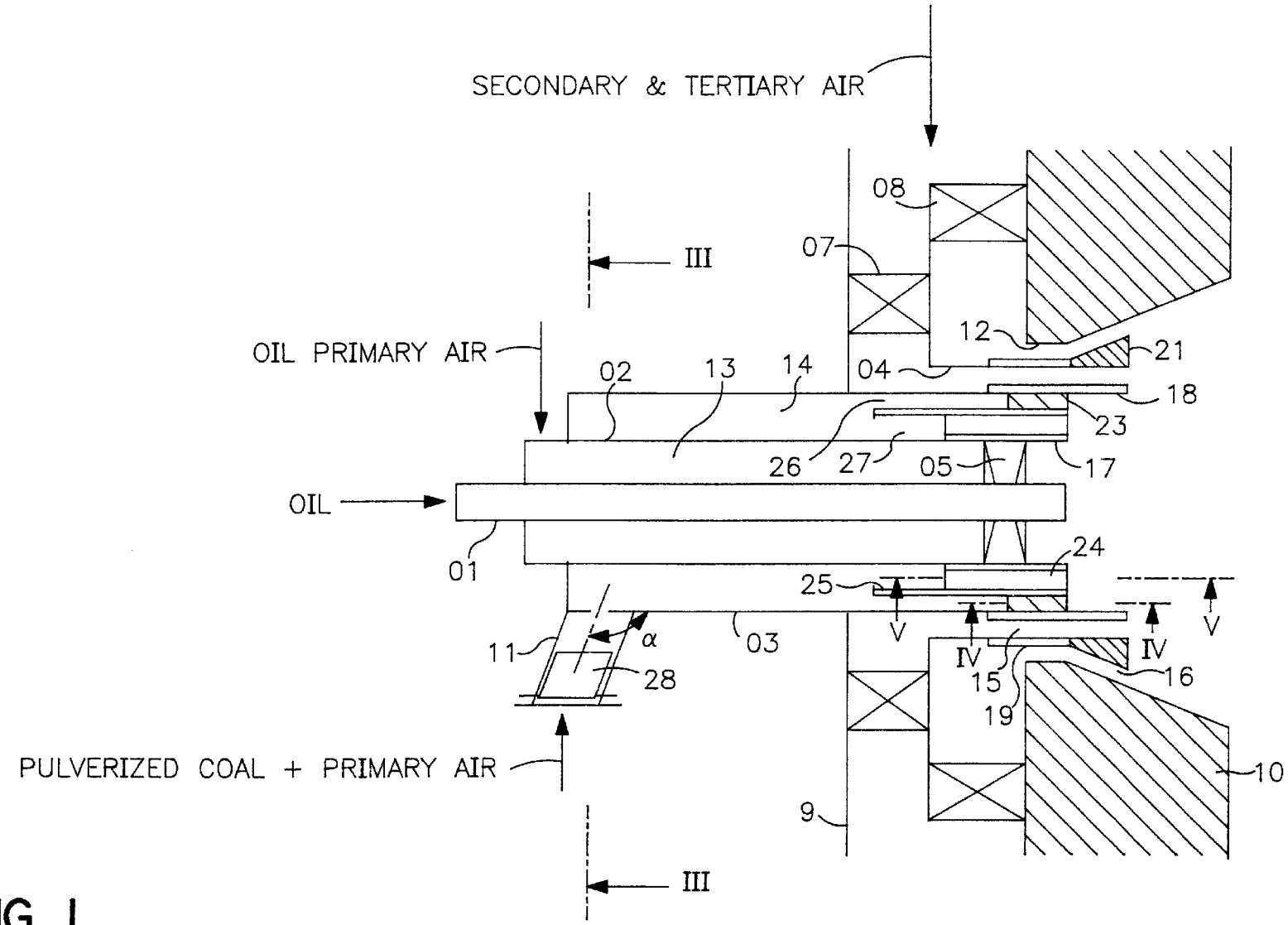
FIG. 1 is a longitudinal sectional view showing a first preferred embodiment according to the present invention.
Figure 2:
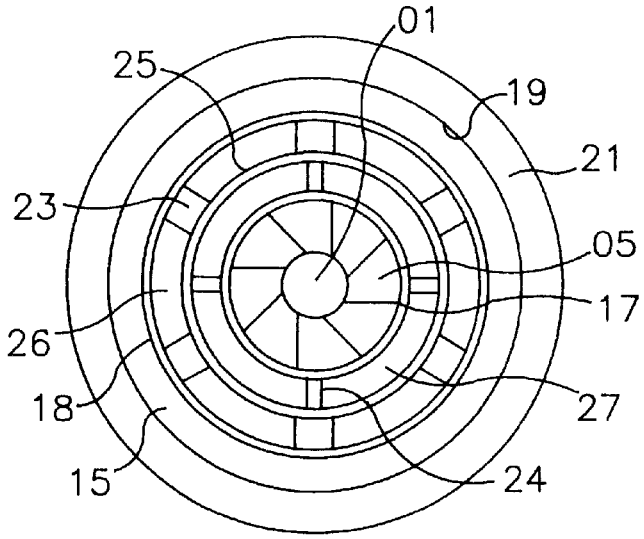
FIG. 2 is a front view of FIG. 1.
Figure 3:
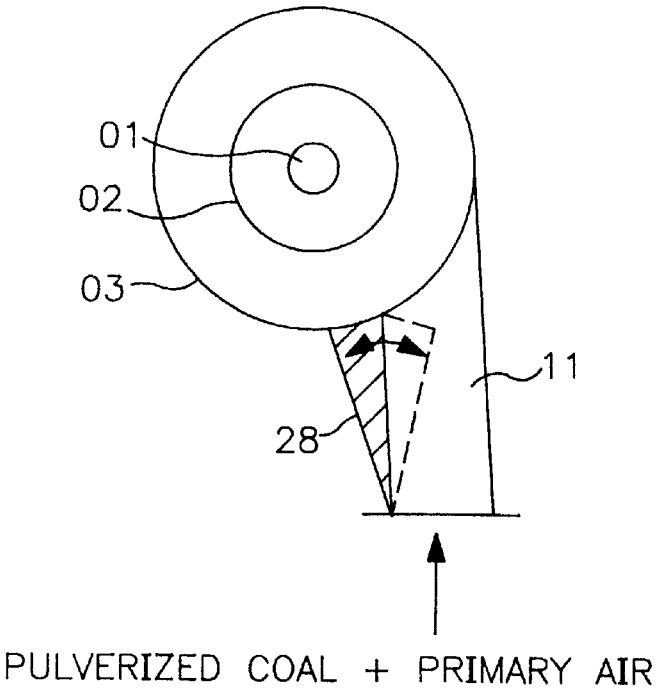
FIG. 3 is a transverse sectional view taken on line III—III of FIG. 1.
Figure 4:
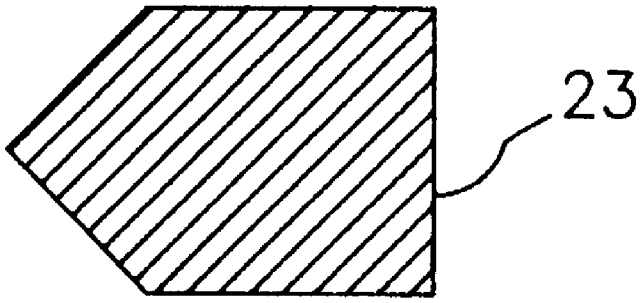
FIG. 4 is a sectional view taken on line IV—IV in the direction of the arrows of FIG. 1.
Figure 5:
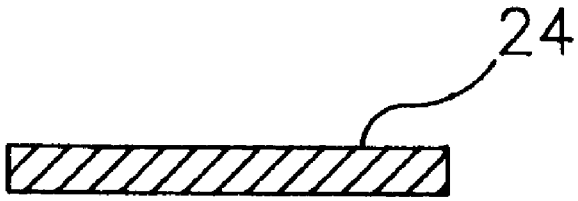
FIG. 5 is a sectional view taken on line V—V in the direction of the arrows of FIG. 1.

Also in this first preferred embodiment, a pulverized coal density dividing cylinder (25) is used to divide the mixture flow path (14) into an outer circumferential portion (26) and an inner circumferential portion (27) is provided. At the outer circumferential portion (26), that is, in a flow path (26) between the pulverized coal density dividing cylinder (25) and a primary air pipe (03), a plurality of block-like splitters (23) as shown in FIG. 4 are provided in the circumferential direction. At the inner circumferential portion (27), that is, in a flow path (27) between the pulverized coal density dividing cylinder (25) and an oil primary air pipe (02), a plurality of rectifying plates (24) as shown in FIG. 5 are provided to rectify the flow parallel to the axis line.

Further in this first preferred embodiment, a secondary air nozzle (18) and a tertiary air nozzle (19) which form the terminal end of a secondary air flow path (15) and a tertiary air flow path (16) are provided. Both project to the front of a pulverized coal nozzle (17), which forms the terminal end of the mixture flow path (14). On the outer side of the terminal end portion of the tertiary air nozzle (19), a dummy refractory (21) is provided so that the terminal end portion of the tertiary air flow path (16) opens in a direction facing toward the outside.

In this first preferred embodiment as mentioned above, as the pulverized coal supply pipe (11) is connected in the tangential direction, the pulverized coal and primary air mixture is given swirl forces. A mixture of dense pulverized coal is formed on the outer circumferential portion and a mixture of thin pulverized coal is formed on the inner circumferential portion, each of which flows into the outer circumferential flow path (26) and the inner circumferential flow path (27), respectively, divided by the pulverized coal density dividing cylinder (25). Further, the density distribution in the circumferential direction becomes uniform due to the swirl force.

Upon the mixture being jetted into a furnace while it is flowing and swirling, the pulverized coal flames diffuse in wide angles, and not only does the $NO_x$ increase by a sudden mixing with the tertiary air, but also, by the combustion flames colliding with the furnace wall according to the arrangement of the burner, there occurs a problem of slagging or CO increase, etc. Hence the pulverized coal mixture is preferably a flow with a weak swirling flow or a straight flow in parallel with the burner axis. In this first preferred embodiment, the block-like splitters (23) provided in the flow path (26) on the outer side of the pulverized coal density dividing cylinder (25) at the terminal end portion of the burner serve to weaken the swirl flow of the dense mixture as well as to strengthen the flame stabilizing by the Karman vortex generated downstream of the splitters (25). On the other hand, the rectifying plates (24) provided in the flow path (27) on the inner side of the pulverized coal density dividing cylinder (25) rectify the thin mixture into a straight flow and the thin mixture is ignited to burn by the radiation heat from the dense mixture flames.

The movable block (28) provided at the pulverized coal supply pipe (11) controls swirl forces of the pulverized coal by adjusting the entering angle of the primary air and pulverized coal mixture. Accompanying the lowering of combustion load, the pulverized coal density in the pulverized coal mixture lowers relatively due to a limitation of mill air flow, and the ignition becomes unstable. Accompanying this, if the movable block (28) is moved in the direction in which the pivotal radius becomes larger, the pulverized coal concentrates under the centrifugal force in the flow path (26) on the outer side of the pulverized coal density dividing cylinder (25), and even if the combustion load lowers, the pulverized coal density on the outer side of the pulverized coal density dividing cylinder (25) is maintained at a certain level and a stable ignition is secured.

Also in this first preferred embodiment, as the secondary air nozzle (18) and the tertiary air nozzle (19) are provided in front of the pulverized coal nozzle (17), the contact of the secondary air jetted in parallel with the pulverized coal mixture with the flames is delayed. As a result, interference of the secondary air with the pulverized coal mixture before it is ignited can be prevented.

Further in this first preferred embodiment, as the terminal end portion of the tertiary air flow path (16) opens in a direction facing to the outside with the dummy refractory (21) on the outer face of the terminal end portion of the tertiary air nozzle (19), the tertiary air forms a large circulation flow so as to wrap the flames. A wide range of $NO_x$ reduction area is thus formed, and $NO_x$ is decreased.

The number of the splatters (23) provided on the circumference at the terminal end portion of the flow path (dense mixture flow path) (26) on the outer side of the pulverized coal density dividing cylinder (25) is preferably three or more. And the area ratio of the splitters (23) to the sectional area of the dense mixture flow path (26) is preferably in a range of 15% to 30%. The rectifying plates (24) provided in the flow path (thin mixture flow path) (27) on the inner side of the pulverized coal density dividing cylinder (25) are plane plates in the preferred embodiment and the length is preferably the pivotal pitch or more and the number is preferably three or more.

As described above, in an axial symmetrical cylinder type pulverized coal burner according to the present invention, the pulverized coal is divided, dense and thin, by the swirl force. A uniform ignition face and a stable ignition on the entire circumference of the burner can be obtained by a means of controlling the swirl force according to the load and by the splitters or the rectifying plates provided at the terminal end of the pulverized coal nozzle.

Further, by the jetting position and direction of the secondary air nozzle and the tertiary air nozzle being optimized, a wide range of $NO_x$ reduction area is formed and $NO_x$ can be decreased.

(Second Preferred Embodiment)

Figure 6:
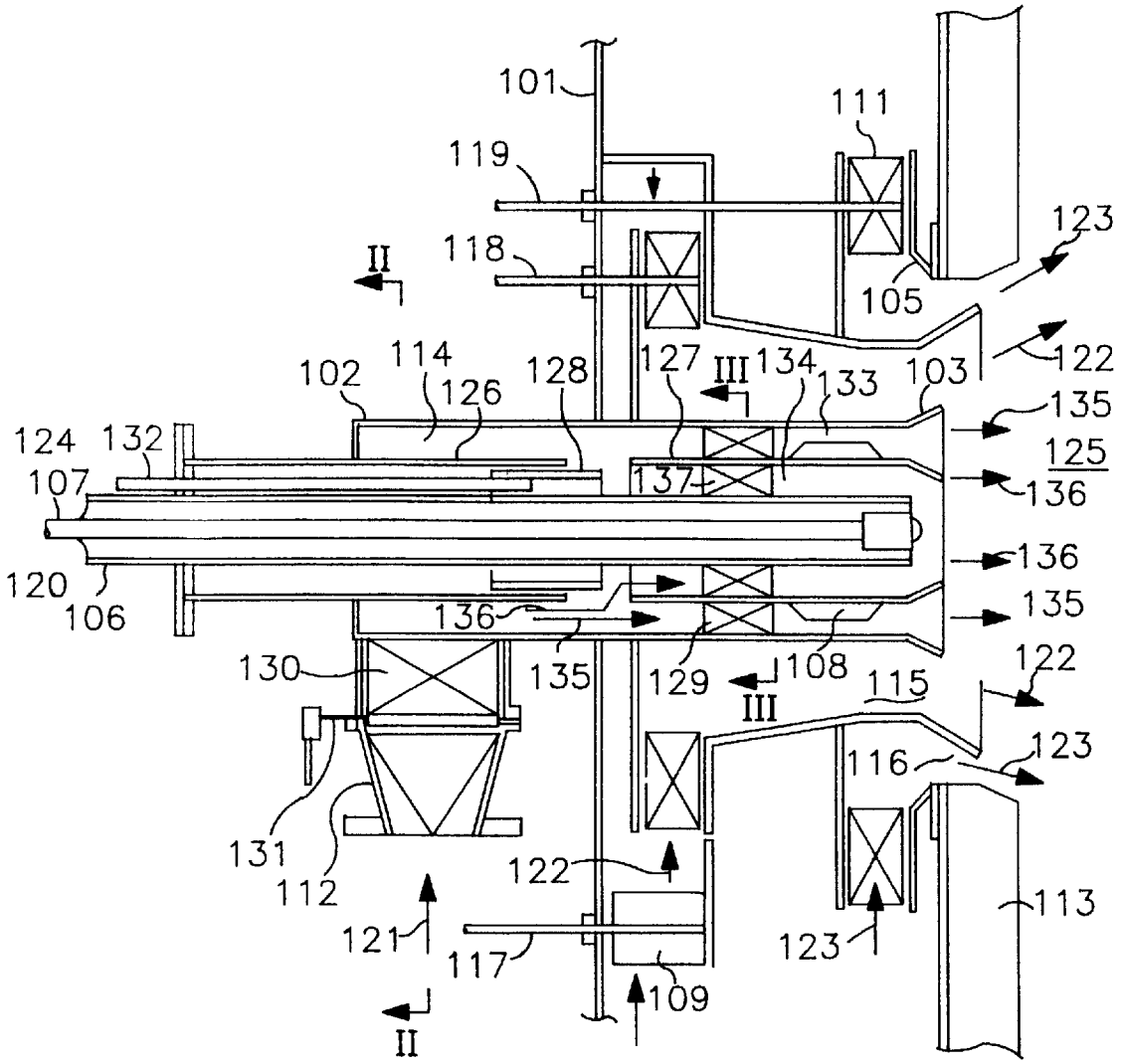
FIG. 6 is a longitudinal sectional view showing a second preferred embodiment according to the present invention.
Figure 7:
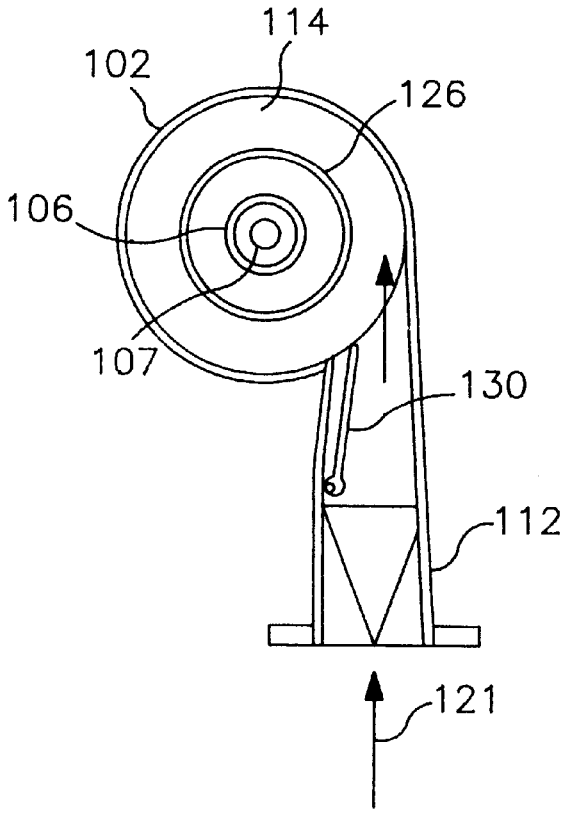
FIG. 7 is a transverse sectional view taken on line II—II in the direction of the arrows of FIG. 6.
Figure 8:
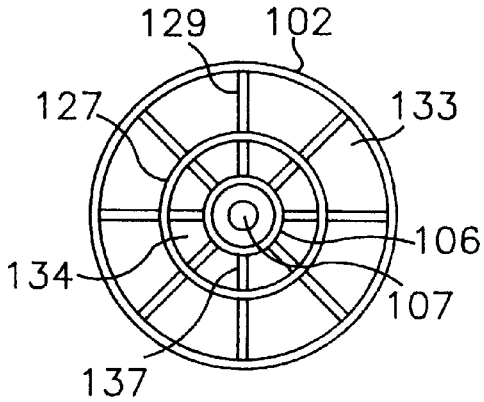
FIG. 8 is a transverse sectional view taken on line III—III, in the direction of the arrows of FIG. 6.
Figure 14:
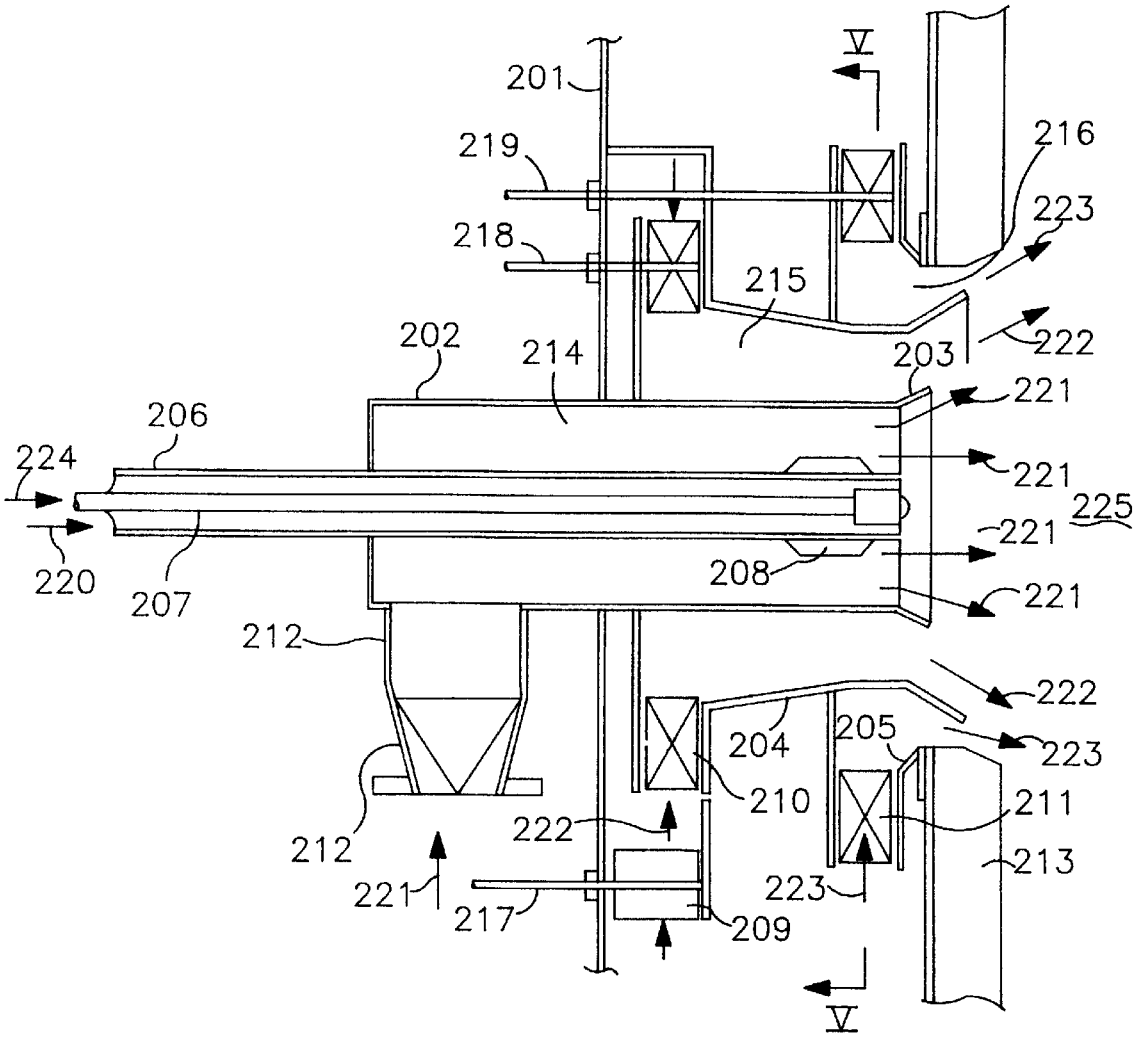
FIG. 14 PRIOR ART
FIG. 14 is a longitudinal sectional view showing an example of a coal firing cylinder type burner in the prior art.
Figure 15:
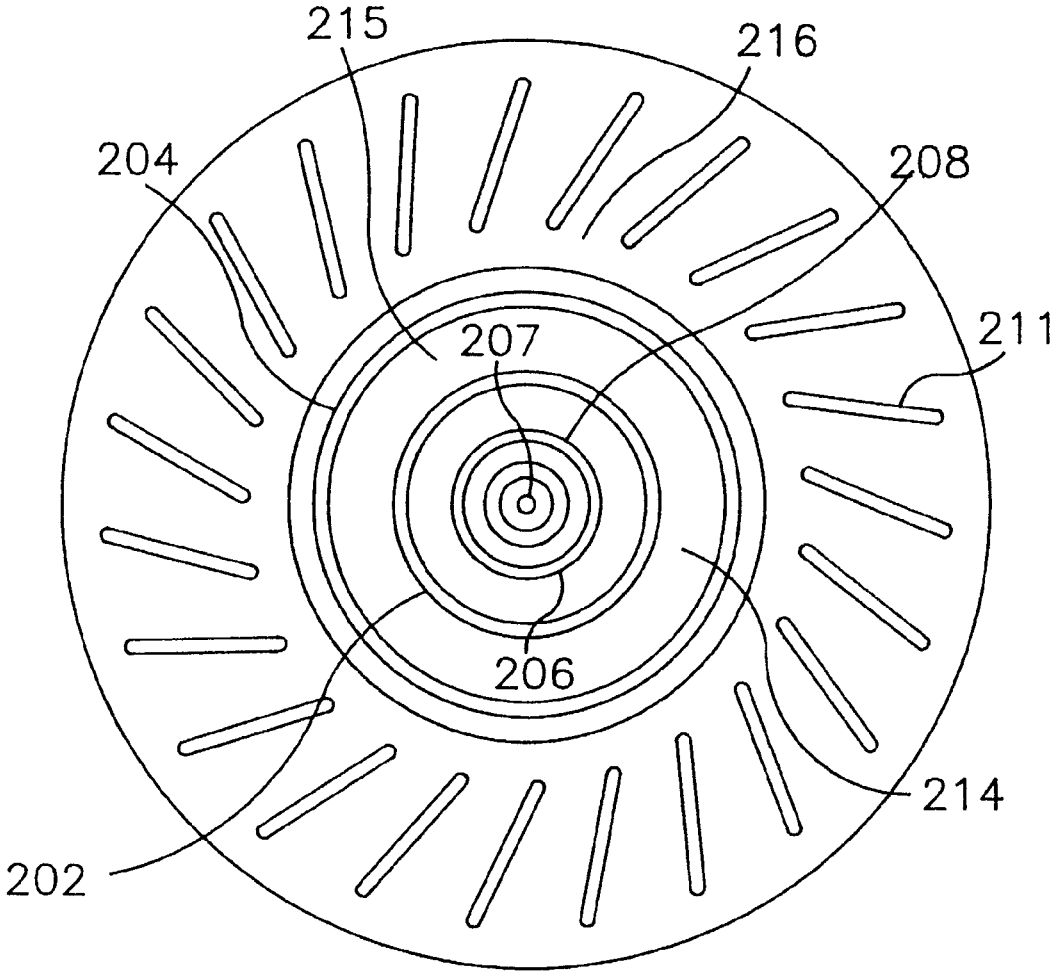
FIG. 15 PRIOR ART
FIG. 15 is a transverse sectional view taken on line V—V in the direction of the arrows of FIG. 14.
Figure 16:
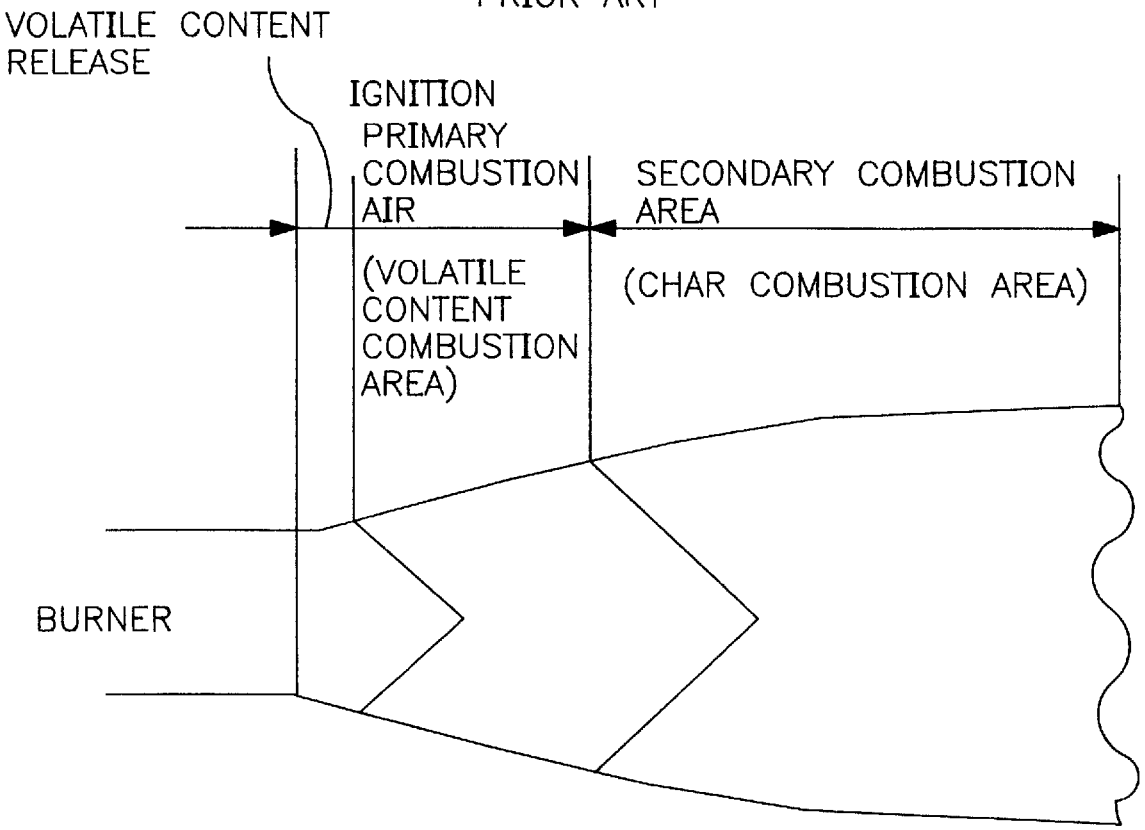
FIG. 16 PRIOR ART
FIG. 16 is a schematic drawing showing a model of a pulverized coal flame.

A second preferred embodiment shown in FIG. 6 to FIG. 8 is described. In FIG. 6 to FIG. 8, the same or similar components or parts as those in the prior art described in FIG. 14 and FIG. 15 is given a numeral obtained by subtracting 100 from the numeral used in FIG. 14 or FIG. 15 and further detailed description is omitted.

In FIG. 6 to FIG. 8, numeral (102) designates a cylindrical pulverized coal mixture cylinder, the front end of which is open in the direction of the inside of a boiler furnace (125), numeral (112) designates a pulverized coal mixture throwing pipe connected in the tangential direction to the rear end of said pulverized coal mixture cylinder (102), numeral (130) designates a pulverized coal mixture throwing velocity adjusting plate provided at the connecting portion of the pulverized coal mixture throwing pipe (112) and the pulverized coal mixture cylinder (102), and numeral (131) designates an operation lever thereof. Numeral (127) designates a pulverized coal density dividing cylinder, which divides the inside front portion of the pulverized coal mixture cylinder (102) into an outer portion and an inner portion, respectively, to form an annular sectional dense mixture path (133) on the outer side and an annular sectional thin mixture path (134) on the inner side. Numeral (128) designates a dense/thin mixture amount adjusting damper provided with a space at the rear portion of the pulverized coal density dividing cylinder (127), which is reciprocally movable within a pulverized coal mixture inner cylinder (126) by an operation lever (132). Numerals (129) and (137) designate a dense mixture swirl prevention plate provided in the dense mixture pat h (133) and a thin mixture swirl prevention plate provided in the thin mixture path (134), respectively. Numeral (108) designates a cylindrical pulverized coal dense/thin separator provided on the outer circumference of the pulverized coal density dividing cylinder (127) in front of the dense mixture swirl prevention plate (129). It is reduced at its front and rear portions.

A pulverized coal mixture (121) supplied from a coal pulverizing equipment (not shown) is blown in the tangential direction into the pulverized coal mixture cylinder (102) from the pulverized coal mixture throwing pipe (112). At this time, the blowing velocity of the pulverized coal mixture (121) is continuously appropriately maintained by the pulverized coal mixture throwing velocity adjusting plate (130) provided within the pulverized coal mixture throwing pipe (112).

The pulverized coal mixture (121) blown into the pulverized coal mixture cylinder (102) receives the centrifugal force, and a dense mixture (135) in which the pulverized coal density is high is formed on the outer circumferential portion, or on the inner wall side of the pulverized coal mixture cylinder (102), and a thin mixture (136) is formed on the inner circumferential portion, or on the outer wall side of the pulverized coal mixture inner cylinder (126), respectively. The dense mixture (135) formed on the outer circumferential portion flows into the annular sectional dense mixture path (133) formed between the pulverized coal mixture cylinder (102) and the pulverized coal density dividing cylinder (127). The thin mixture (136) formed on the inner circumferential portion flows through an opening portion between the pulverized coal mixture inner cylinder (126) and the pulverized coal density dividing cylinder (127) into the annular sectional thin pulverized coal mixture path (134) formed between the pulverized coal density dividing cylinder (127) and a guide pipe (106) for an oil burner gun. The amount of the thin mixture (136) is adjusted by the dense/thin mixture amount adjusting damper (128) controlling the opening amount between the pulverized coal mixture inner cylinder (126) and the pulverized coal density dividing cylinder (127).

If the jet flow of the dense mixture is a swirl flow, expansion of the jet flow becomes large and a diffusion mixing with secondary air (122) blown from the outer circumference is accelerated. Hence the $NO_x$ generation amount increases and the diameter of the pulverized coal flame enlarges. But in this second preferred embodiment, the dense mixture (135) that flows into the dense mixture path (133) is prevented from swirling by the dense mixture swirling a prevention plate (129) to become a straight flow. The flow of the dense mixture (135) which is has its swirl flow component removed is accelerated while it passes along the outer circumference of the pulverized coal dense/thin separator (108), and then suddenly expands and is decelerated at the outlet portion of the dense mixture path (133). At this time, as the pulverized coal within the dense mixture (135) flows for the most part under a bias along the inner wall face side of the outlet portion of the dense mixture path (133) by inertia force, the jet flow of the dense mixture (135), immediately after it is blown into the boiler furnace (125), forms a pulverized coal mixture of a further high density on its surface side.

On the other hand, the thin mixture (136) has its swirl flow component removed by the thin mixture swirl prevention plate (137) in the thin mixture path (134) and is blown into the boiler furnace (125) as a straight flow.

As for the pulverized coal mixture blown into the boiler furnace (125), the dense mixture (135) of a high pulverized coal density is securely formed on the outer circumferential side and the thin mixture (136) of a thin pulverized coal density is securely formed on the inner side, and a pulverized coal flame having a stable ignition point can be attained. Further, as both the dense and thin mixtures (135), (136) are blown as straight flows, there is no impediment to ignition caused by a dispersion of the dense mixture (135).

If the combustion amount in the boiler furnace (125) decreases, the pulverized coal density (pulverized coal amount/primary air amount) of the pulverized coal mixture (121) supplied from the coal pulverizing equipment (not shown) decreases. But in this case the throwing velocity of the pulverized coal mixture (121) is accelerated by the pulverized coal mixture throwing velocity adjusting plate (130), the pulverized coal density of the dense pulverized coal mixture (135) is heightened by the separation efficiency of the pulverized coal being heightened, and formation of a stable pulverized coal flame is attained.

According to the burner of the present invention as mentioned above, as the pulverized coal density on the surface side of the pulverized coal mixture jet flow blown into the furnace can be maintained at a high density for a wide range of burner load, an always stable pulverized coal flame can be formed. And even with a low volatile content coal of a high fuel ratio, stable combustion becomes possible.

(Third Preferred Embodiment)

Figure 9A:
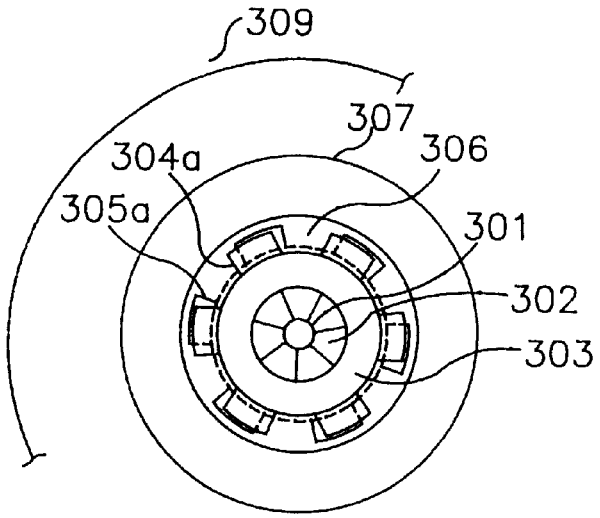
FIG. 9 is a drawing of a main part of a third preferred embodiment according to the present invention, wherein FIG. 9(*a*) is a front view and FIG. 9(*b*) is a right side sectional view (longitudinal sectional view).
Figure 9B:
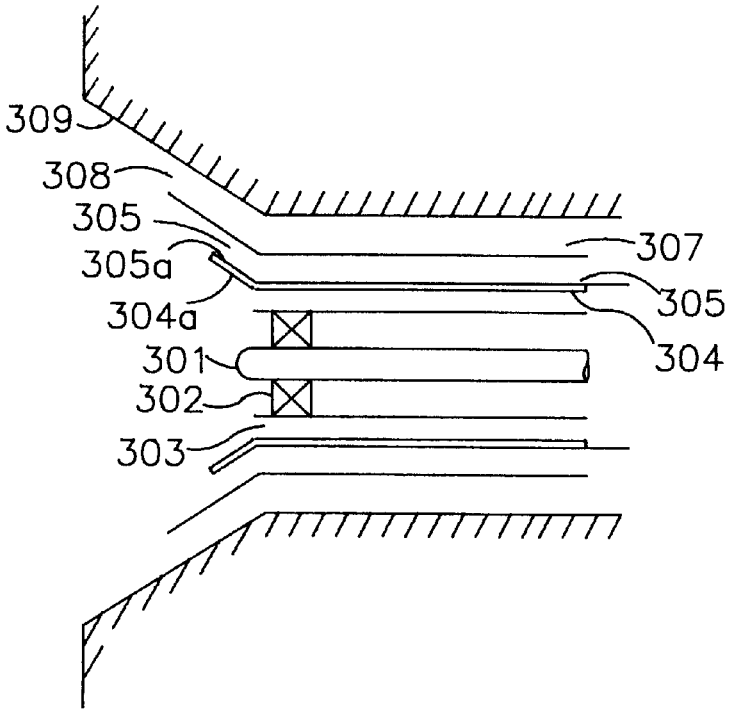
Figure 10A:
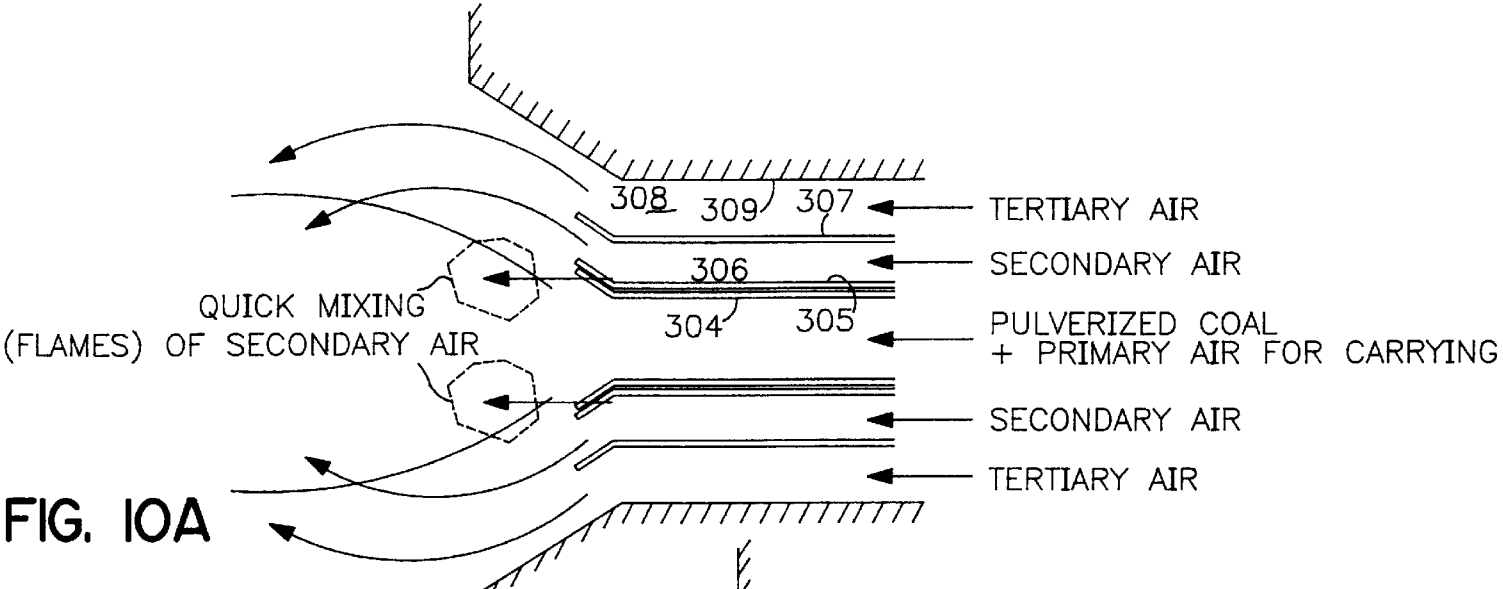
FIG. 10 is a drawing showing a functional comparison between the third preferred embodiment and an example in the prior art, wherein FIG. 10(*a*) shows the third preferred embodiment and FIG. 10(*b*) shows the prior art.
Figure 10B:
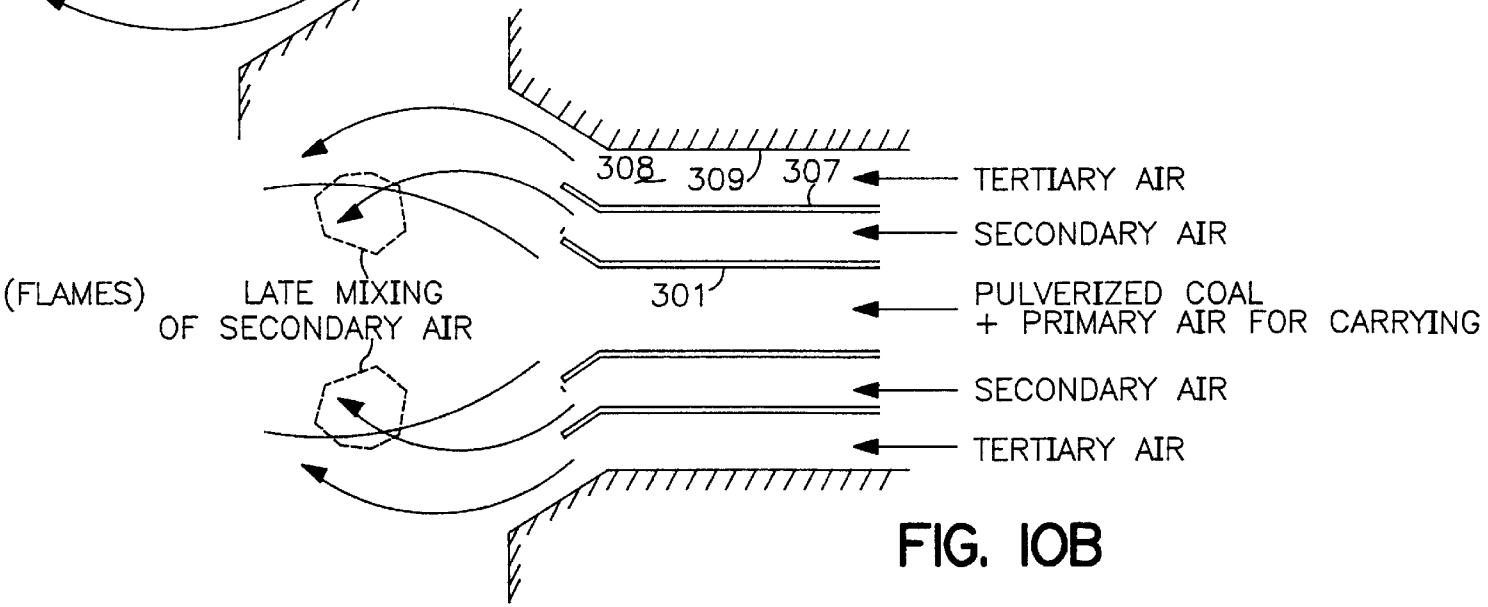
Figure 17:
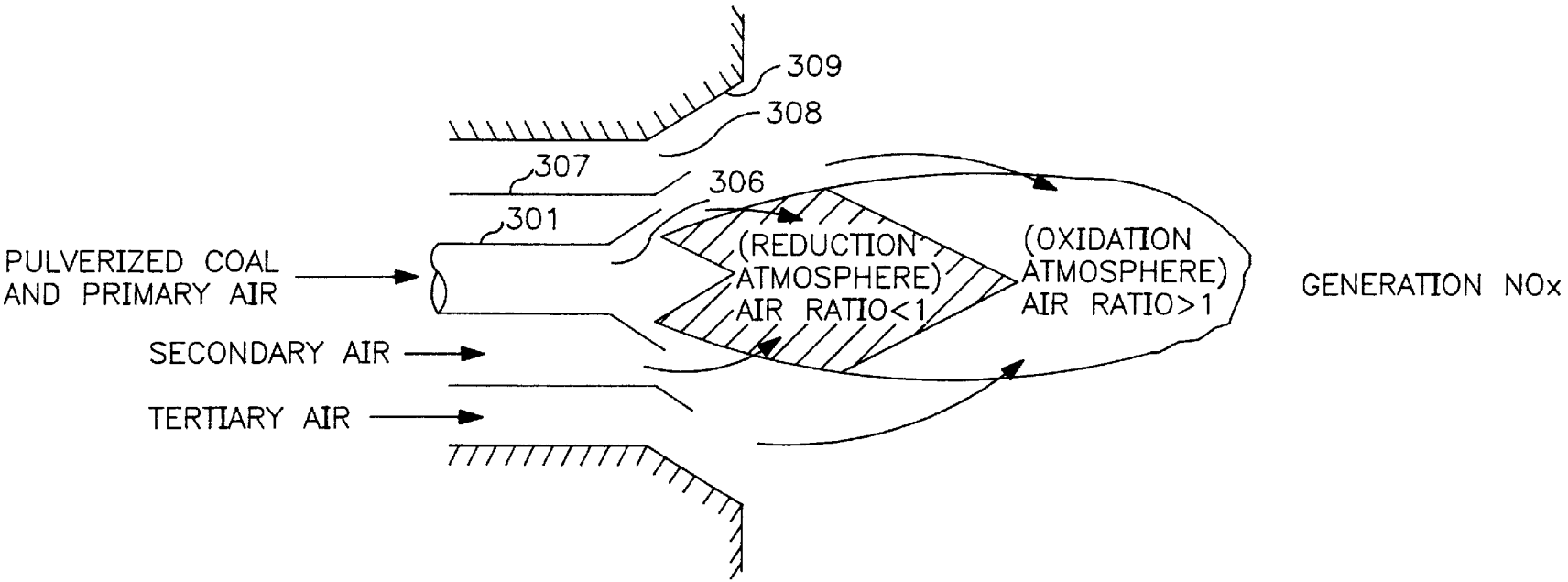
FIG. 17 PRIOR ART
FIG. 17 is a schematic longitudinal sectional view of a main part of an example of a burner in the prior art.
Figure 18:
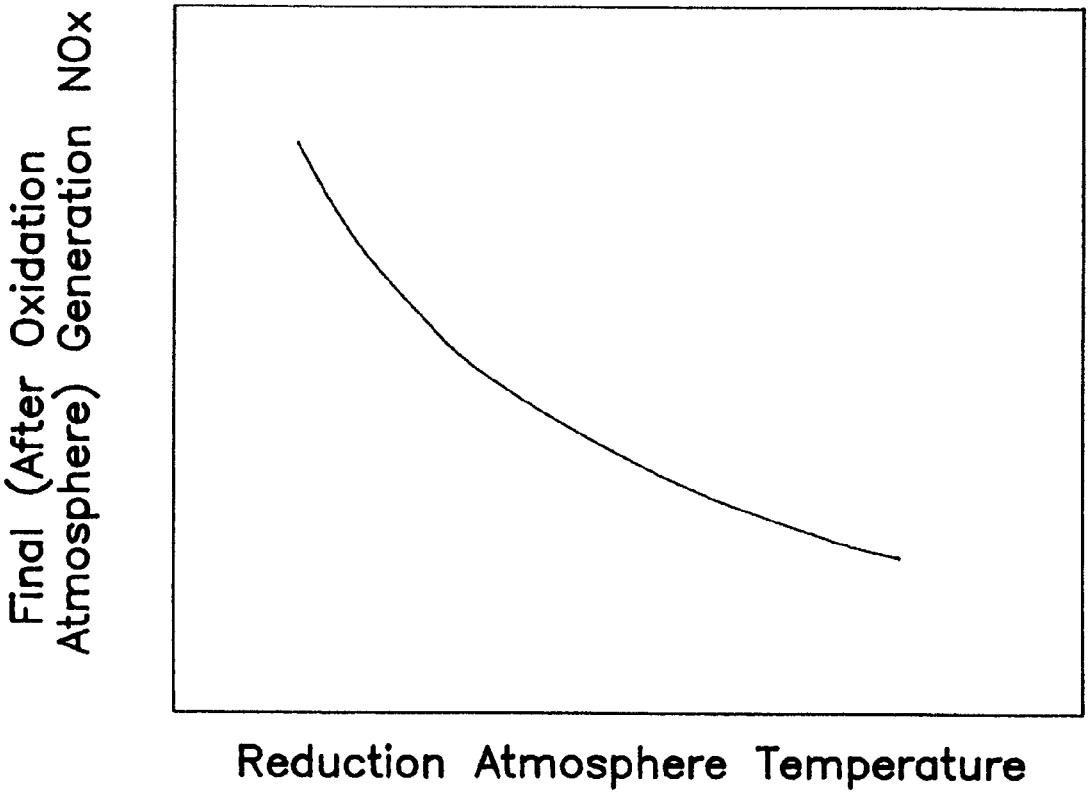
FIG. 18 PRIOR ART
FIG. 18 is a diagram showing a relation between the final $NO_x$ generation and the reduction atmospheric temperature of an example in the prior art.
Figure 19:
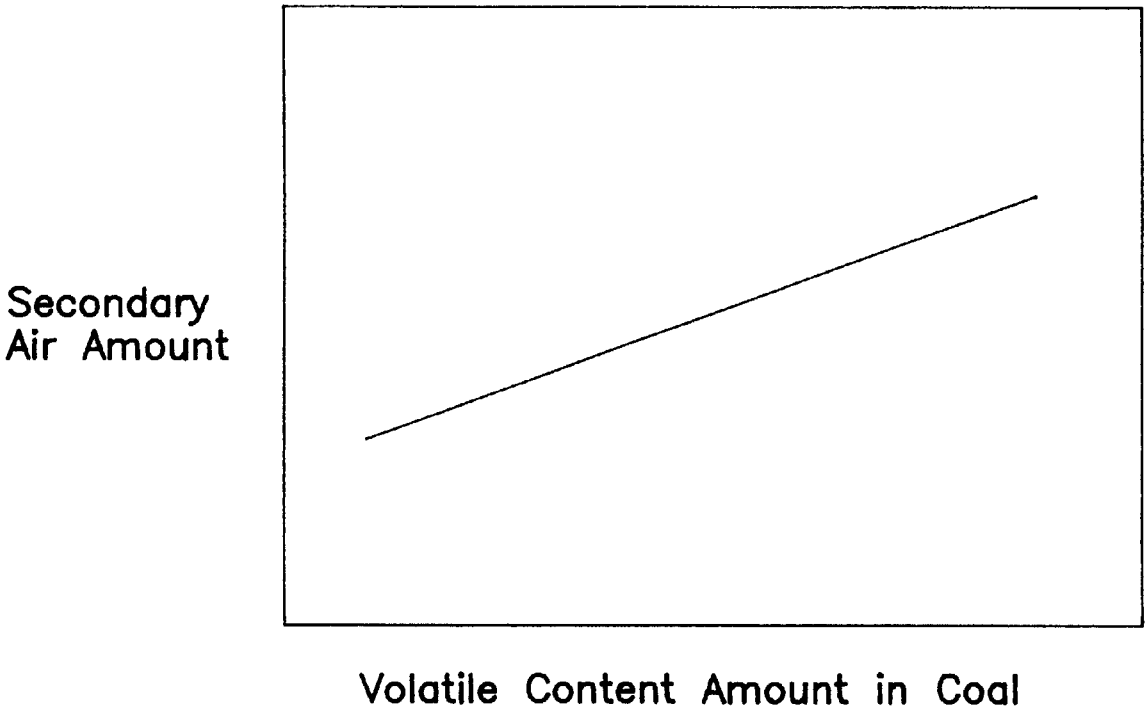
FIG. 19 PRIOR ART
FIG. 19 is a diagram showing a general relation between a secondary air amount and a coal volatile content amount.

A third preferred embodiment shown in FIG. 9 and FIG. 10 is described. In FIG. 9 and FIG. 10, the same or similar components or parts as those in the prior art described in FIG. 17 is given the same numerals and further description is omitted except where necessary. FIG. 9 and FIG. 10 show only the terminal end portions of the pulverized coal burner which are the featured portions of the third preferred embodiment. The pulverized coal supply pipe is connected in the tangential direction to the pulverized coal and primary air mixture flow path as with pulverized coal burners of the first preferred embodiment and the second preferred embodiment.

In FIG. 9, numeral (301) designates a burning oil tip which is an ignition means of the burner body provided at the center of a furnace wall port (309) along the port axis and numeral (302) designates an oil combustion air port which is a flame maintaining means. Incidentally, the burning oil tip (301) and the oil combustion air port (302) are hereinafter sometimes referenced collectively as "a burner body", which corresponds to the portion of a burner body (301') in the prior art shown in FIG. 17 removed from the outer cylinder having a funnel-like terminal end.

Numeral (303) designates a pulverized coal and carrying air jet port surrounding the outer circumference of the burner body, numeral (304) designates a fixed cylinder (forming an inner cylinder and being fixed) surrounding the burner body via the pulverized coal and carrying air jet port (303) and having an inner flange (304*a*) which opens at the terminal end like a funnel and is intermittently cut off along the circumference, numeral (305) designates a movable cylinder (outer cylinder) fitted on and surrounding the fixed cylinder (304), having an outer flange (305*a*) of the same shape as the inner flange (304*a*) of the fixed cylinder (304) at the terminal end and rotatable relative to the fixed cylinder (304) around the cylinder axis, numeral (306) designates a secondary air jet port, numeral (307) designates an outer circumferential cylinder and numeral (308) designates a tertiary air jet port. The construction is otherwise the same as the example in the prior art.

Following is a description on the function of the burner of the third preferred embodiment of the above-mentioned construction.

Upon the movable cylinder (305) being rotated relative to the fixed cylinder (304) around the axis nearly by a length of the width of the outer flange (305*a*) (or the inner flange (304*a*)), the cut-off portions of the inner flange (304*a*) are closed by the outer flange (305*a*) and the inner flange (304*a*) and the outer flange (305*a*) connect each other so that a funnel-like flange is formed around the fixed cylinder (304) (or movable cylinder (305)). That is, the same shape as the example in the prior art is obtained.

In this state, the burner body is ignited and the pulverized coal is supplied together with air from the pulverized coal and carrying air jet port (303), and upon the combustion flame being sufficiently formed, the movable cylinder (305) is rotated by an appropriate amount according to the kind of coal and is stopped at a point when a $NO_x$ sensor (not shown) shows a minimum $NO_x$ value. Needless to mention, a series of these operations may be automatically performed by a drive means via a computer, which is preferable.

As a result of the above, a part of the air passing the secondary air jet port (306) does not jet in a funnel shape but enters into the combustion area in a straight flow through the cutoff portions made by lapping of the inner flange (304*a*) and the outer flange (305*a*). Thus the high temperature $NO_x$ just generated in the reduction atmosphere is supplied with $O_2$ and is urged to convert to $N_2$. and a low $NO_x$ is attained efficiently.

FIG. 10 is a drawing showing a functional comparison of these functions with an example in the prior art. A part of the secondary air flows in with straight lines in this third preferred embodiment as shown by arrows in FIG. 10(*a*), while the secondary air in the example in the prior art flows in with loop lines as shown in FIG. 10(*b*).

According to this third preferred embodiment as mentioned above, as the inner flange (304*a*) of the fixed cylinder (304) and the outer flange (305*a*) of the movable cylinder (305) connect or separate from each other in the circumferential direction and a part of the flow path of the secondary air is formed straight at equal spaces in the circumferential direction, the secondary air is accelerated to mix in the combustion area, especially in the high temperature reduction atmosphere. Thus conversion of $NO_x$ to $N_2$ is sufficiently performed, and thus there is an advantage in that a low $NO_x$ is attained efficiently.

Further, there is an advantage in that by the inner flange (304*a*) and the outer flange (305*a*) being connected or separated appropriately, application to various kinds of coal becomes possible.

Thus, the burner so constructed as mentioned above has the following effect.

As the flange of the inner cylinder and the flange of the outer cylinder are connected or separated by rotation in the circumferential direction and a part of the flow of the secondary air into the combustion faces can be made straight, the $NO_x$ can be converted to $N_2$ in close vicinity to the high temperature reduction atmosphere, and a low $NO_x$ can be attained efficiently.

Further, as the straight flow amount of the secondary air can be controlled by the connection or the separation of the flanges, application to various kinds of coal becomes possible.

While the preferred forms of the present invention have been described, variations thereto will occur to those skilled in the art within the scope of the present inventive concepts, which are delineated by the following claims.

What is claimed is:

1. A pulverized coal combustion burner, comprising:

an oil gun at a center portion;

an annular sectional oil primary air flow path surrounding said oil gun;

an annular sectional pulverized coal and primary air mixture flow path surrounding said oil primary air flow path;

an annular sectional secondary air flow path surrounding said mixture flow path;

an annular sectional tertiary air flow path surrounding said secondary air flow path; and a pulverized coal supply pipe connected in a tangential direction to said mixture flow path.

2. The pulverized coal combustion burner of claim 1, wherein a throwing velocity adjusting plate for adjusting the velocity of a mixture of pulverized coal and primary air is provided within said pulverized coal supply pipe.

3. The pulverized coal combustion burner of claim 2, and further comprising a pulverized coal density dividing cylinder that divides said mixture flow path into an outer portion and an inner portion so as to form a dense mixture flow path in said outer portion and a thin mixture flow path in said inner portion.

4. The pulverized coal combustion burner of claim 3, wherein said outer portion and said inner portion comprise a plurality of flow path splitters and a plurality of rectifying plates, respectively, at outlet ends thereof.

5. The pulverized coal combustion burner of claim 3, wherein said outer portion and said inner portion comprise a dense mixture swirl prevention plate and a thin mixture swirl prevention plate, respectively.

6. The pulverized coal combustion burner of claim 3, wherein said pulverized coal density dividing cylinder has a dense/thin mixture amount adjusting damper.

7. The pulverized coal combustion burner of claim 6, wherein a pulverized coal mixture inner cylinder is located in said mixture flow path such that an opening is formed between said pulverized coal mixture inner cylinder and said pulverized coal density dividing cylinder, said dense/thin mixture amount adjusting damper being located so as to regulate said opening.

8. The pulverized coal combustion burner of claim 1, wherein an angle control means for controlling an entering angle of a mixture of pulverized coal and primary air into said mixture flow path is provided within said pulverized coal supply pipe.

9. The pulverized coal combustion burner of claim 1, wherein said mixture flow path is defined by an inner cylindrical body having an axis and a flange that opens at a terminal end in a first crenelated funnel shaped member, said first crenelated funnel shaped member having a second crenelated funnel shaped member mounted thereon and of the same shape as said first crenelated funnel shaped member, said second crenelated funnel shaped member being rotatable relative to and around the axis of said inner cylindrical body.

10. The pulverized coal combustion burner of claim 9, wherein said first and second crenelated funnel shaped members extend into the path of said annular sectional secondary air flow path surrounding said mixture flow path such that rotation of said first and second crenelated funnel shaped members relative to each other varies the size of openings formed thereby to vary the amount of secondary air tending to flow straight from said annular sectional secondary air flow path.

11. The pulverized coal combustion burner of claim 1, wherein said annular sectional tertiary flow path has an outlet end that flares outwardly and is defined at least in part by a dummy refractory located between said annular sectional tertiary flow path and said annular sectional secondary air flow path.

12. A pulverized coal combustion burner, comprising:

an oil gun;

an annular oil primary air pipe surrounding said oil gun;

an annular pulverized coal and primary air mixture pipe surrounding said oil primary air pipe;

an annular sectional secondary air pipe surrounding said mixture pipe;

an annular sectional tertiary air pipe surrounding said secondary air pipe; and a pulverized coal supply pipe having an outlet connected to said mixture pipe and extending from said outlet tangentially with respect to said mixture pipe.

13. The pulverized coal combustion burner of claim 12, wherein a throwing velocity adjusting plate for adjusting the velocity of a mixture of pulverized coal and primary air is provided within said pulverized coal supply pipe.

14. The pulverized coal combustion burner of claim 13, and further comprising a pulverized coal density dividing cylinder that divides said mixture flow path into an outer portion and an inner portion so as to form a dense mixture flow path in said outer portion and a thin mixture flow path in said inner portion.

15. The pulverized coal combustion burner of claim 14, wherein said outer portion and said inner portion comprise a plurality of flow path splitters and a plurality of rectifying plates, respectively, at outlet ends thereof.

16. The pulverized coal combustion burner of claim 14, wherein said outer portion and said inner portion comprise a dense mixture swirl prevention plate and a thin mixture swirl prevention plate, respectively.

17. The pulverized coal combustion burner of claim 14, wherein said pulverized coal density dividing cylinder has a dense/thin mixture amount adjusting damper.

18. The pulverized coal combustion burner of claim 17, wherein a pulverized coal mixture inner cylinder is located in said mixture pipe such that an opening is formed between said pulverized coal mixture inner cylinder and said pulverized coal density dividing cylinder, said dense/thin mixture amount adjusting damper being located so as to regulate said opening.

19. The pulverized coal combustion burner of claim 12, wherein an angle control means for controlling an entering angle of a mixture of pulverized coal and primary air into said mixture pipe is provided within said pulverized coal supply pipe.

20. The pulverized coal combustion burner of claim 12, wherein said mixture pipe is defined by an inner cylindrical body having an axis and a flange that opens at a terminal end in a first crenelated funnel shaped member, said first crenelated funnel shaped member having a second crenelated funnel shaped member mounted thereon and of the same shape as said first crenelated funnel shaped member, said second crenelated funnel shaped member being rotatable relative to and around the axis of said inner cylindrical body.

21. The pulverized coal combustion burner of claim 20, wherein said first and second crenelated funnel shaped members extend into the path of said annular secondary air pipe surrounding said mixture pipe such that rotation of said first and second crenelated funnel shaped members relative to each other varies the size of openings formed thereby to vary the amount of secondary air tending to flow straight from said annular secondary air pipe.

22. The pulverized coal combustion burner of claim 12, wherein said annular tertiary pipe has an outlet end that flares outwardly and is defined at least in part by a dummy refractory located between said annular tertiary pipe and said annular secondary air pipe.

* * * * *